US006609335B1

(12) United States Patent
Hyakkoku

(10) Patent No.: US 6,609,335 B1
(45) Date of Patent: Aug. 26, 2003

(54) DOOR SUPPORTING DEVICE

(75) Inventor: Yutaka Hyakkoku, Ebina (JP)

(73) Assignee: Japan Uniflow Col, Ltd., Tokyo (JP)

( * ) Notice: Subject to any disclaimer, the term of this patent is extended or adjusted under 35 U.S.C. 154(b) by 0 days.

(21) Appl. No.: 10/251,813

(22) Filed: Sep. 23, 2002

(30) Foreign Application Priority Data

May 24, 2002 (JP) ..... 2002-150722

(51) Int. Cl.[7] ..... E05D 7/08
(52) U.S. Cl. ..... 49/388; 16/229
(58) Field of Search ..... 49/381, 388, 397, 49/399; 16/229, 230, 231

(56) References Cited

U.S. PATENT DOCUMENTS 3,730,577 A * 5/1973 Shanok et al. ..... 49/394
4,677,707 A * 7/1987 Holler ..... 16/239
5,483,770 A * 1/1996 Marinoni ..... 49/388
6,381,909 B1 * 5/2002 Liao ..... 49/399
6,418,590 B1 * 7/2002 Nipper et al. ..... 16/229

* cited by examiner

*Primary Examiner*—Jerry Redman
(74) *Attorney, Agent, or Firm*—Keil & Weinkauf

(57) ABSTRACT

A door supporting device for supporting a door in a door frame is disclosed. The device includes an upper unit, which further includes a frame attachment member to be fixed to a door frame header; a frame-side connector member rotatably connected to the frame attachment member and having an adjuster aperture; a door-side connector member connected to a rotation shaft extending from the door and detachably connected to the frame-side connector member; and an eccentric bolt connected to the frame attachment member through the adjuster aperture. The eccentric bolt is exposed from the adjuster aperture with a portion of the eccentric bolt being in contact with periphery of the adjuster aperture. Rotation of the eccentric bolt makes the frame-side connector member to rotate to adjust alignment of the door with respect to the door frame in a direction of depth of the door.

6 Claims, 8 Drawing Sheets

(a) Counterclockwise rotation

(b) Initial position

(c) Clockwise rotation

DOOR SUPPORTING DEVICE

DETAILED DESCRIPTION OF THE INVENTION

1. Field of Art

The present invention relates to a door supporting device, in particular a door supporting device having alignment adjuster means.

2. Background Art

Various types of door supporting devices are conventionally known for supporting a door in a corresponding door frame defining a doorway. Some of them attaches a door in a door frame by suspending the door from above. Such door supporting devices are often used for installing so called a "swing door" having a door closer in its upper portion. For adjusting alignment of the door with respect to the frame, an adjuster mechanism is usually provided in the door closer on the door side, rather than in the door supporting device, for spatial or operational reasons.

The recent trend is that the door closer is partially or entirely embedded in a door for improving aesthetic appearance of the door. However, in this case also, external access to the adjuster mechanism provided in the embedded closer must be allowed for carrying out necessary adjustment of alignment of the door. For this purpose, access windows are often provided by cutting out a portion of decorative laminates on the door.

Formation of such access windows in decorative laminates on the surface of the door, even if partially, will result in patched door surfaces, which impairs aesthetic appearance of the door.

On the other hand, addition of the adjuster mechanism to the door closer, which originally has a complex structure itself, adds further complexity to the structure of the closer, and thus undesirably increases its manufacturing cost.

The conventional adjuster mechanism also has a problem in that, due to its complicated working mechanism, precise adjustment with this mechanism may be carried out only by a skilled operator. Thus a user tends to leave alignment troubles caused by long-standing use of the door, even if occurred.

SUMMARY OF THE INVENTION

The present invention aims to solve the above problems. It is therefore an object of the present invention to provide a door supporting device which does not impair aesthetic appearance of a door, and which enables anyone to readily adjust alignment of a door with respect to the corresponding door frame.

It is another object of the present invention to provide a door supporting device having a simple structure which may be manufactured without significant increase in its manufacturing steps.

It is yet another object of the present invention to provide a door supporting device which provides improved precision in adjusting door alignment.

It is still another object of the present invention to provide a door supporting device which extends the degree of freedom in adjustment of the door alignment.

According to the present invention, there is provided a door supporting device for supporting a door in a door frame comprising an upper unit, said upper unit further comprising:

a frame attachment member to be fixed to a header of a door frame;

a frame-side connector member rotatably connected to said frame attachment member, said frame-side connector member having an adjuster aperture;

a door-side connector member connected to a rotation shaft extending from an upper surface of said door and detachably connected to said frame-side connector member; and an eccentric bolt connected to said frame attachment member through said adjuster aperture in the frame-side connector member, said eccentric bolt being exposed from said adjuster aperture with at least a portion of said eccentric bolt being in contact with periphery of the adjuster aperture;

wherein rotation of said eccentric bolt makes said frame-side connector member to rotate to adjust alignment of the door with respect to the door frame in a direction of depth of said door.

BRIEF DESCRIPTION OF THE DRAWINGS

The present invention will now be explained in more detail with reference to the attached drawings illustrating by way of example the preferred embodiments of the present invention in which.

PREFERRED EMBODIMENTS OF THE PRESENT INVENTION

A preferred embodiment of the present invention will now be explained in detail.

Figure 1:
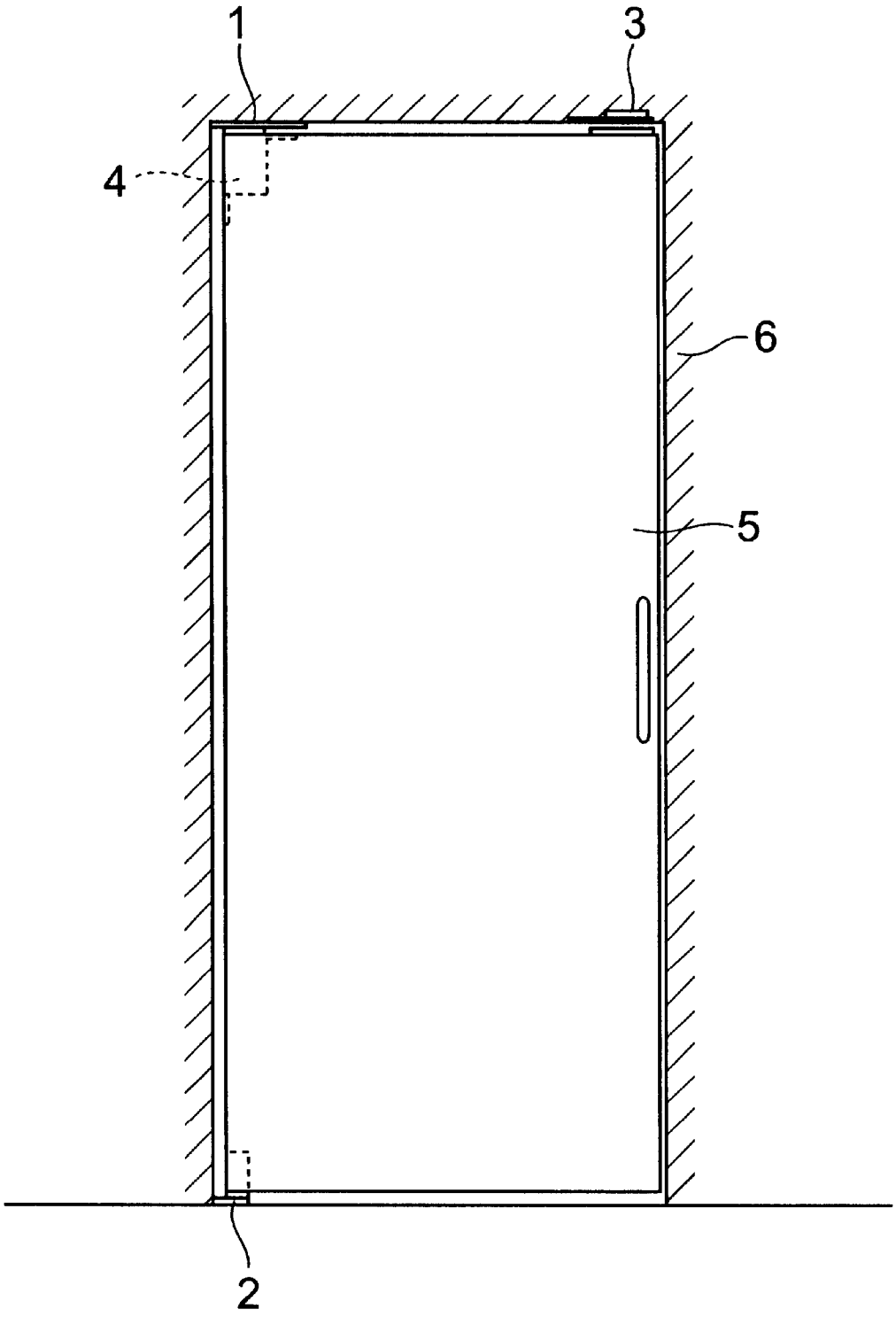
FIG. 1 is a schematic view showing a use of an embodiment of the door supporting device according to the present invention on a right-hand door.

FIG. 1 is a front view of a right-hand door 5 supported in a door frame 6 and equipped with a door supporting device according to the present invention. In this embodiment, the door supporting device includes an upper unit 1, a lower unit 2, and a swing stopper 3. The upper unit 1 is located at the upper pivot corner of the door 5 and the frame 6 to suspend the door 5 from above, and the lower unit 2 is located at the lower pivot corner of the door 5 and the frame 6 to support the door from below. The swing stopper 3 is located in the upper portion of the door 5 and the frame 6, specifically in the upper corner region near the leading edge of the door 5 and the frame 6.

Figure 2:
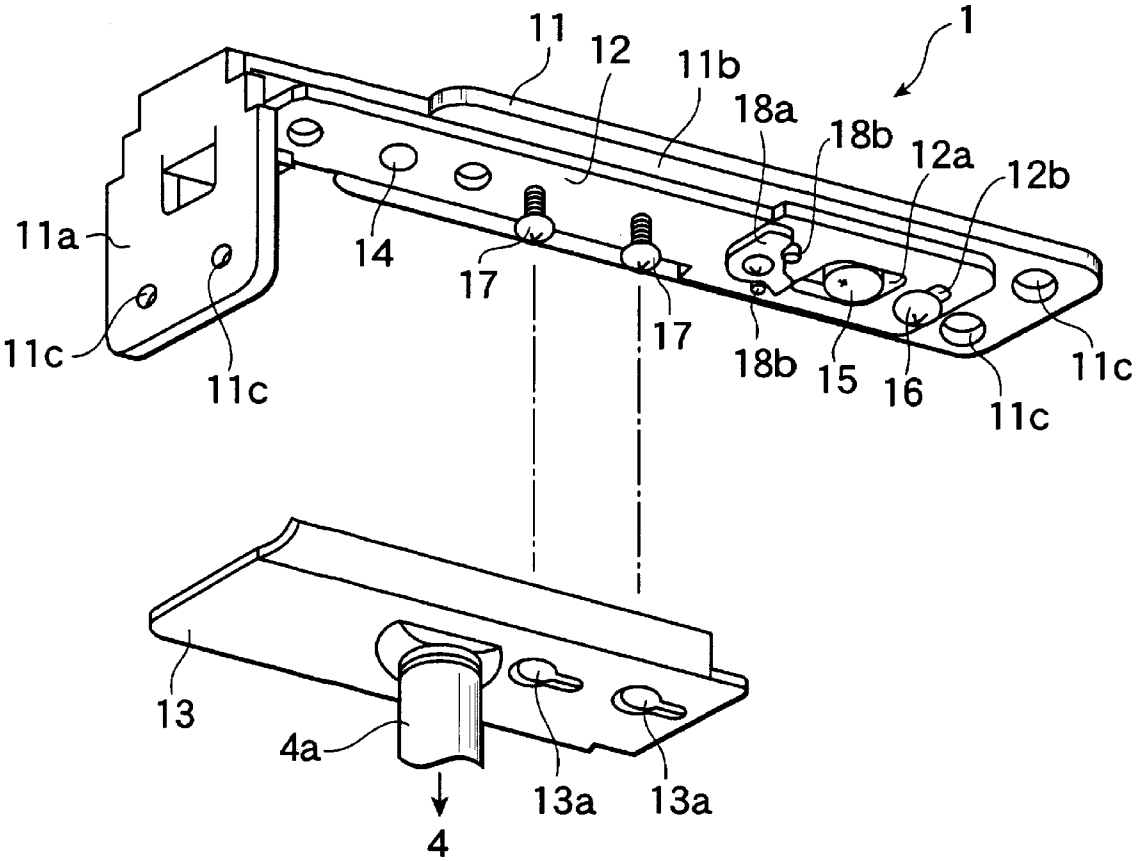
FIG. 2 is a perspective view of an embodiment of the upper unit of the door supporting device according to the present invention.
Figure 3:
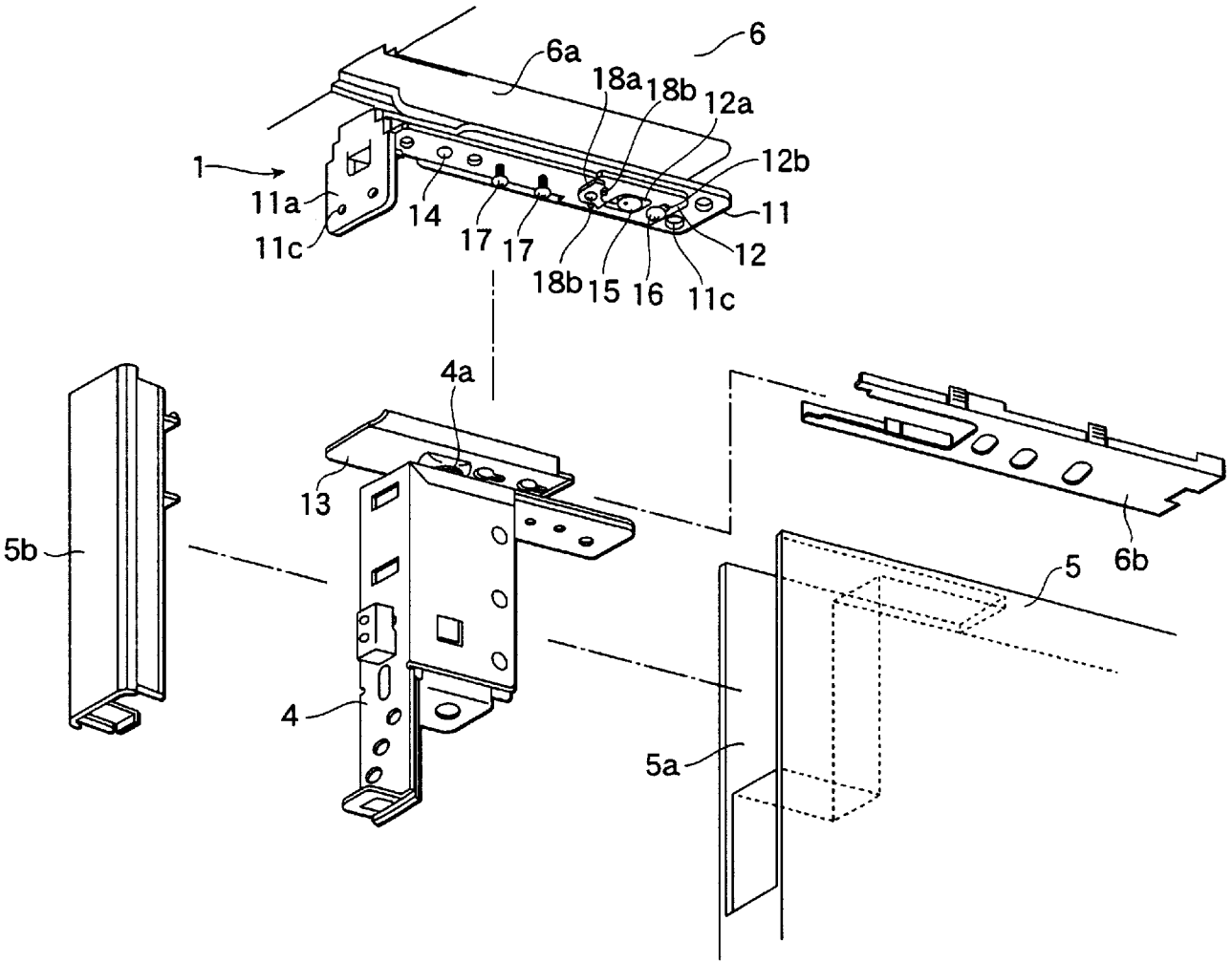
FIG. 3 is a perspective view, partially exploded, showing how to install the upper unit of FIG. 2 and a door closer to a right-hand door and a door frame.

Referring to FIGS. 2 and 3, the upper unit 1 includes an L-shaped frame attachment member 11 to be fixed at the upper pivot corner of the door frame 6, a frame-side connector member 12 rotatably connected to the frame attachment member 11, and a door-side connector member 13 detachably connected to the frame-side connector member 12 and also connected to a rotation shaft 4*a* of a door closer device 4 embedded in a cut-out 5*a* in the upper pivot corner of the door 5.

The door closer device 4 may be of any conventional closer device as long as the rotation shaft 4*a* is extended from the upper surface of the door when the device is embedded in the door, and thus the mechanism of this device is not discussed in detail. For example, a device for automatically controlling the swing of a door, or a device for controlling only the limit of the swing of a door may be embedded in the cut-out 5*a* in the door, and used in place of the door closer device 4 as means for controlling the door swing.

The cut-out 5*a* is provided in the door without cutting out the decorative laminates on the stop and hardware sides of the door 5.

The L-shaped frame attachment member 11 has a vertical section 11*a* and a horizontal section 11*b*, each of which has two screw holes 11*c* in its free end portion. As shown in FIG. 2, the frame-side connector member 12 is rotatably connected to the horizontal section 11*b* of the frame attachment member 11 with a caulking pin 14 in its inner end portion (the left end portion in FIGS. 2 and 3). The caulking pin 14 acts as a rotation axis for the connector member 12 with respect to the attachment member 11.

The frame-side connector member 12 has a depth adjuster aperture 12*a* of a generally rectangular shape in its outer end portion (the right end portion in FIGS. 2 and 3). Through this aperture 12*a* is inserted an eccentric bolt 15 having a generally circular head and an axis eccentric from the center of the head, and connected to the horizontal section 11*b* of the frame attachment member 11. The head of the eccentric bolt 15 is exposed from the aperture 12*a* for allowing access to the bolt 15, and at least a portion of the outer surface of the bolt 15 is in contact with a portion of the periphery of the aperture 12*a*. The depth adjuster aperture 12*a* and the eccentric bolt 15 cooperate to enable alignment of the door in the direction of its depth in a manner to be discussed later.

The frame-side connector member 12 also has an alignment fixing hole 12*b* located closer to its outer end than the adjuster aperture 12*a*. An alignment fixing screw 16 is inserted through this hole 12*b* and screwed into the horizontal section 11*b* of the frame attachment member 11 for fixing the frame-side connector member 12 in a properly aligned position to the frame attachment member 11.

A stopper 18*a* having two arms is rotatably mounted on the frame-side connector member 12. Rotation of this stopper 18*a* is limited by two limiting pins 18*b* protruding from the frame-side connector member 12 by contacting the arms with the pins.

Two linking screws 17 are screwed into the frame-side connector member 12 for connecting the door-side connector member 13 to the frame-side connector member 12.

The door-side connector member 13 has two lateral adjuster holes 13*a* for receiving the linking screws 17 therein. These adjuster holes 13*a* are arranged at positions corresponding to the positions of the linking screws 17 on the frame-side connector member 12 when the door-side connector member 13 is placed over the frame-side connector member 12 as will be explained later. Each of the lateral adjuster holes 13*a* has a shape of a combination of a circular hole having the diameter corresponding to that of the head of the linking screw 17, and an elongate hole having the width corresponding to the diameter of the shank of the linking screw 17.

The linking screws 17 and the lateral adjuster holes 13*a* cooperate to allow lateral sliding of the door-side connector member 13 with respect to the frame-side connector member 12, with the linking screws 17 being placed in the adjuster holes 13*a*, for allowing alignment of the door 5 in the direction of its width (lateral alignment) in a manner to be discussed later.

The number of the lateral adjuster holes 13*a* and the liking screws 17 are not particularly limited, and may be one, two, or more. However, for stable connection between the frame-side connector member 12 and the door-side connector member 13, two or more holes and screws are preferred.

The door-side connector member 13 also has a mechanism to allow connection to the rotation shaft 4*a* of the door closer device 4.

As shown in FIG. 3, cover plates 5*b* and 6*b* are fitted in the cut-out 5*a* in the door 5 and the cut-out 6*a* in the frame 6, respectively, for concealing the upper unit 1 and the door closer device 4 and improving aesthetic appearance of the door and the door frame.

Figure 4:
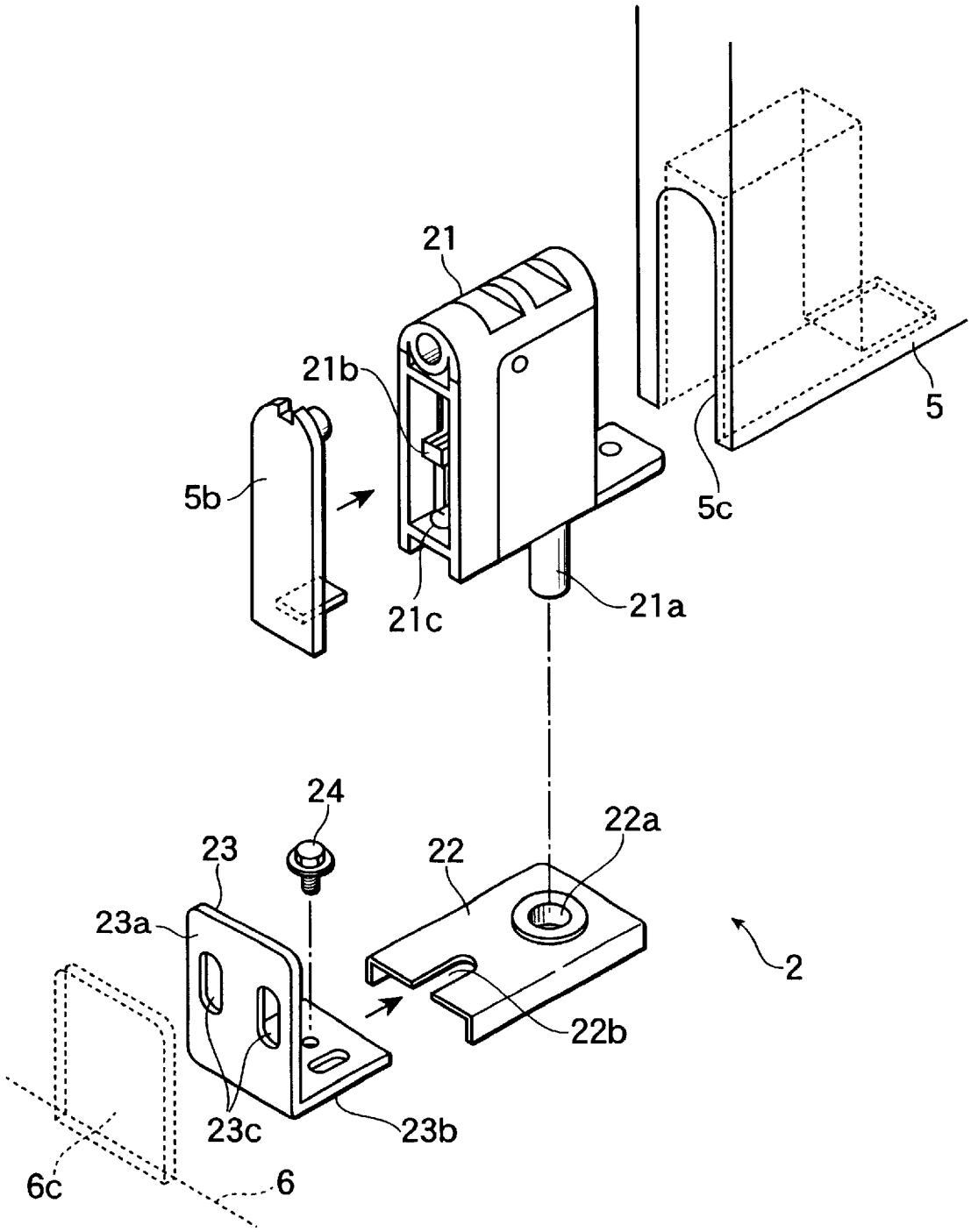
FIG. 4 is a perspective view, partially exploded, showing how to install an embodiment of the lower unit of the door supporting device according to the present invention, to a right-hand door and a door frame.

FIG. 4 shows the details of the lower unit 2. The lower unit 2 includes shaft housing 21 which has a retractable supporting shaft 21*a*, and is to be embedded in a lower portion of the door 5, specifically in a cut-out 5*c* provided in the lower pivot corner of the door 5, a shaft bearing member 22 for supporting the shaft 21*a*, and an L-shaped frame attachment member 23 to be fixed to the jamb of the door frame 6 at the lower pivot corner.

The cut-out 5*c* is provided in the door without cutting out the decorative laminates on the stop and hardware sides of the door 5.

The shaft housing 21 has a built-in mechanism (not shown) which retracts and retains the shaft 21*a* in its retracted position in the housing 21 when a slider 21*b* is pushed up, and automatically projects the shaft 21*a* through the lower end of the shaft housing 21 downwards into its extended position when a release button 21*c* is pressed down to release the shaft 21*a*.

The shaft bearing member 22 has a bushing hole 22*a* penetrating therethrough for receiving and supporting the shaft 21*a* in its extended position, and a lateral adjuster slit 22*b*.

The frame attachment member 23 has a vertical section 23*a* having two elongate slots 23*c* penetrating therethrough, and a horizontal section 23*b* having a screw hole into which a hexagon head bolt 24 is screwed. Through the elongate slots 23*c* are inserted screws for fixing the frame attachment member 23 to the frame 6. The elongate slots 23*c* cooperate with the screws to enable alignment of the door in the direction of its height (vertical alignment) in a manner to be discussed later.

The shaft bearing member 22 is slidably inserted over the horizontal section 23*b* of the frame attachment member 23, and fixed at a proper position with the hexagon head bolt 24 inserted through the lateral adjuster slit 22*b* into the screw hole in the horizontal section 23*b*. The lateral adjuster slit 22*b* receives the hexagon head bolt 24 therein and guides the lateral sliding of the shaft bearing member 22 with respect to the frame attachment member 23, and thus cooperate with the hexagon head bolt 24 to enable alignment of the door in the direction of its width (lateral alignment) in a manner to be discussed later.

Figure 5:
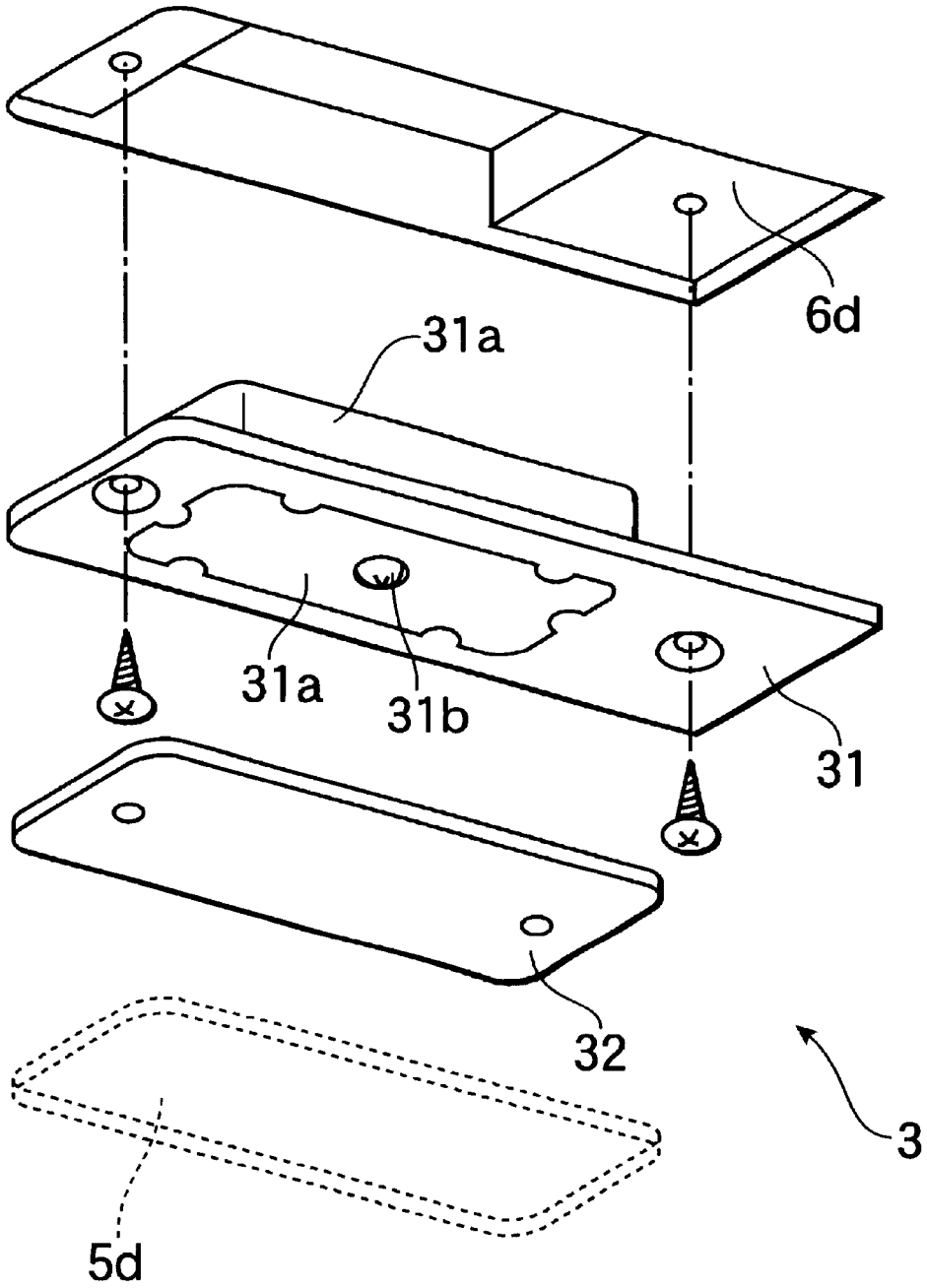
FIG. 5 is a perspective view, partially exploded, showing how to install an embodiment of the swing stopper of the door supporting device according to the present invention, to a door and a door frame.

FIG. 5 shows the details of the swing stopper 3. The swing stopper 3 includes a magnet casing 31 to be embedded in a cut-out 6*d* provided in the header of the frame 6 near the upper corner on the leading edge side, and a counter plate 32 made of a material attracted by magnet. The magnet casing 31 has a magnet housing 31*a*, a magnet (not shown) housed in the magnet housing 31*a*, a mechanism (not shown) for lifting and lowering the housing 31*a*, and a vertical adjuster screw 31*b* for adjustment with respect to the mechanism.

The counter plate 32 is to be embedded in a cut-out 5*d* provided in the upper surface of the door 5 at a location facing to the magnet casing 3.

The swing stopper 3 forces the door 5 to return to its closed position. Thus even when a sudden pressure difference occurs across the door 5, the door 5 will not make a significant swing, and even if swung, may stop soon, by the cooperation of the closer device 4 provided on the pivot edge side of the door and the swing stopper 3 provided on the leading edge side of the door.

Next, the procedure for installing the door 5 to the door frame 6 using the door supporting device of the present invention is explained.

The frame attachment member 11, the frame-side connector member 12, and the parts associated thereto have been pre-assembled. Specifically, the frame-side connector member 12 has been rotatably connected to the frame attachment member 11 by means of the caulking pin 14, the eccentric bolt 15 attached to the attachment member 11, the screw 16 temporarily screwed in the fixing hole 12*b*, and the stopper 18*a* mounted on the connector member 12. The linking screws 17 have also been temporarily screwed in the frame-side connector member 12.

First, the frame attachment member 11 with the frame-side connector member 12 and the associated parts of the upper unit 1 is fixed to the header and jamb of the door frame at the upper pivot corner. This may be done by placing the horizontal section 11*b* in the cut-out 6*a* provided in the header of the frame 6, and inserting and tightening screws through the screw holes 11*c* in the vertical and horizontal sections 11*a* and 11*b* of the frame attachment member 11 into the jamb and header of the frame 6.

The door-side connector member 13 of the upper unit 1 is attached to the rotation shaft 4*a* of the door closer device 4, and the closer device 4 is embedded in the cut-out 5*a* provided in the upper pivot corner of the door 5.

The frame attachment member 23 of the lower unit 2 is temporarily fixed in the cut-out 6*c* provided in the jamb of the frame 6 at the lower pivot corner. This may be done by inserting and temporarily tightening screws through the elongate slots 23*c* in the vertical section 23*a* into the jamb of the frame 6. Here, the vertical length of the slots defines the limit of the range of adjustment of the door 5 with respect to the frame 6 in the direction of height of the door 5 (vertical adjustment).

The shaft bearing member 22 is inserted over the horizontal section 23*b* of the frame attachment member 23, and the hexagon head bolt 24 is inserted through the lateral adjuster slit 22*b* and temporarily screwed into the horizontal section 23*b*. Here, the lateral adjuster slit 22*b* and the hexagon head bolt 24 cooperate to allow adjustment of the door alignment with respect to the frame 6 in the direction of width of the door 5 (lateral adjustment).

The shaft housing 21 is embedded in the cut-out 5*c* provided in the lower pivot corner of the door 5, with the shaft 21*a* having been retracted in its retracted position by pushing up the slider 21*b*.

The magnet casing 31 with the magnet of the swing stopper 3 is embedded and fixed with screws in the cut-out 6*d* provided in the header of the frame 6 near the upper corner on the leading edge side. The counter plate 32 is also embedded and fixed with screws in the cut-out 5*d* provided in the upper surface of the door 5 at a location facing to the magnet casing 31.

Then the door 5 having the closer device 4 with the door-side connector member 13, the shaft housing 21, and the counter plate 32, all attached thereto, is brought to the door frame 6, and the door-side connector member 13 extending horizontally from the rotation shaft 4*a* is placed over the frame-side connector member 12 already attached to the door frame 6, such that the lateral adjuster holes 13*a* in the door-side connector member 13 receive therein the linking screws 17 temporarily fastened to the frame-side connector member 12.

Figure 6:
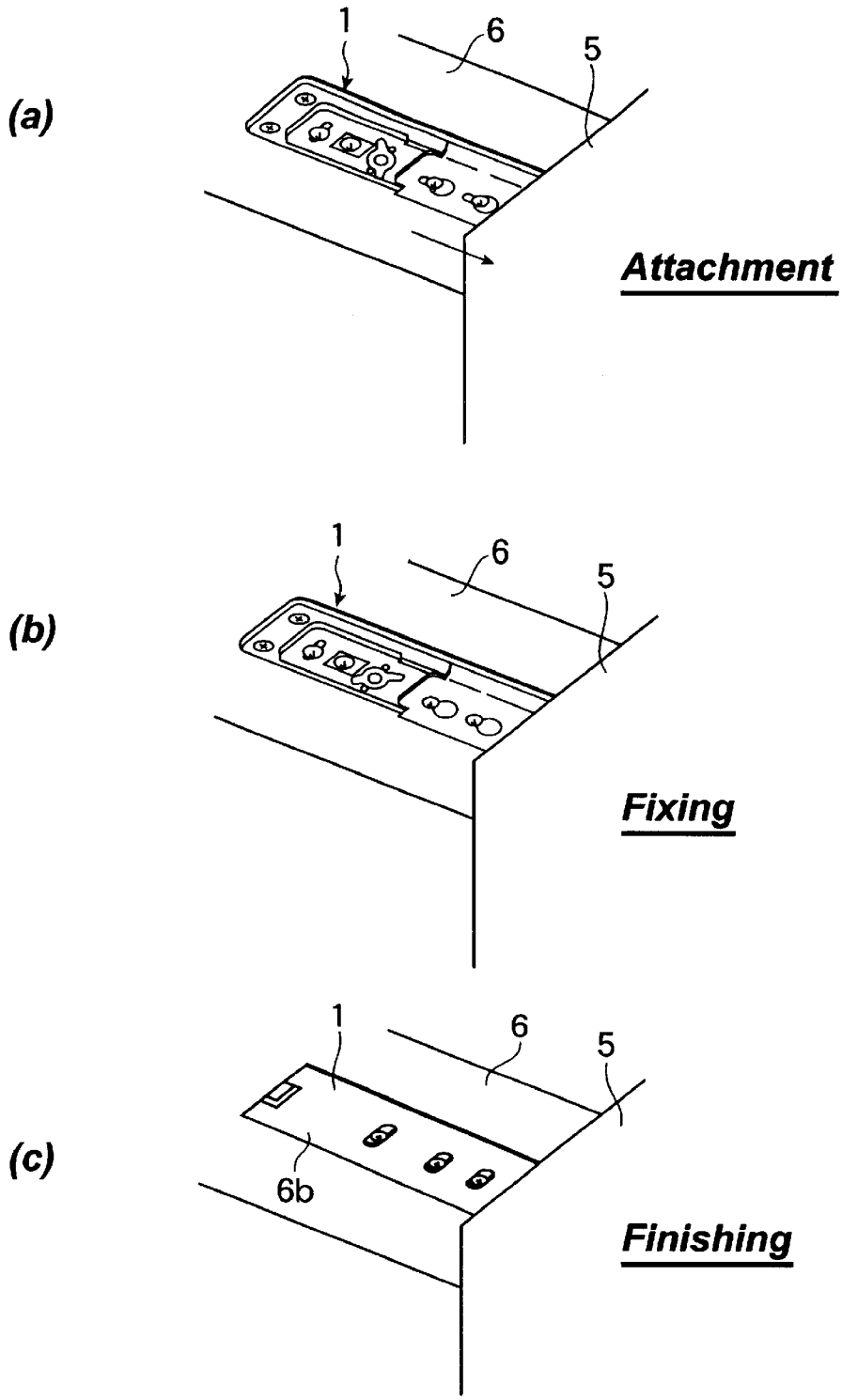
FIG. 6 is an explanatory view illustrating how to install the upper unit of FIG. 2 to a left-hand door.

Next, as shown in FIG. 6(*a*), with the door 5 opened, and the door-side connector member 13 over the frame-side connector member 12, the door-side connector member 13 is slid in the direction of the width of the door 5 to adjust lateral alignment of the door 5 with respect to the door frame 6. This sliding adjustment is guided by the cooperation of the lateral adjuster holes 13*a* and the liking screws 17 received therein.

At an appropriate timing, the release button 21*c* of the shaft housing 21 is pressed down to project the shaft 21*a* downwardly into the bushing hole 22*a* of the shaft bearing member 22 so that the door 5 is supported from below. When the shaft 21*a* cannot be inserted into the bushing hole 22*a*, the hexagon head bolt 24 is loosened, and the lateral position of the shaft bearing member 22 is adjusted. When the adjustment is completed, the bolt 24 is tightened.

When the lateral position of the door 5 is adjusted, with the door-side connector member 13 over the frame-side connector member 12 as shown in FIG. 6(*b*), the linking screws 17 are finally tightened. Then the stopper 18*a* is rotated counterclockwise (as shown in FIG. 6) so that one of its arms is in contact with one of the limiting pins 18*b*. In this state, the other of the arms projects toward the linking screw 17 to limit the sliding range of the door-side connector member 13 toward the leading edge of the door 5.

If no more adjustment of the door alignment is required, then the alignment fixing screw 16 in the alignment fixing hole 12*b* is tightened, and the cover plate 6*b* is fit over the frame-side connector member 12 as shown in FIG. 6(*c*) to complete the door installment.

Figure 7:
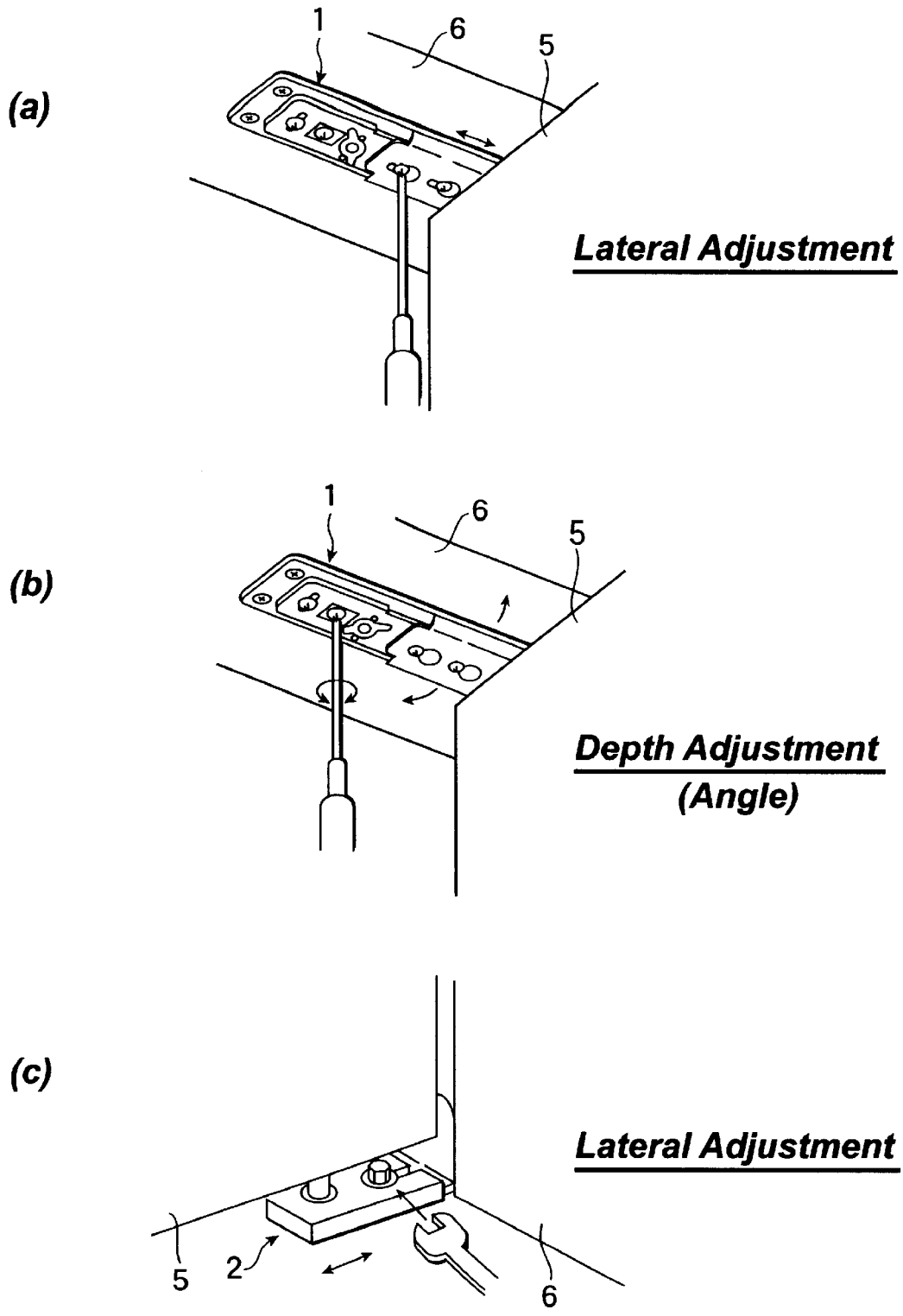
FIG. 7 is an explanatory view illustrating how to adjust the alignment of a left-hand door with the door supporting device of the present invention.

If further adjustment is required, the procedure illustrated in FIG. 7 maybe followed. Namely, the lateral adjustment of the door 5 (in the direction of width of the door) may be made by loosening the linking screws 17 and laterally sliding the door-side connector member 13 with respect to the frame-side connector member 12 as shown in FIG. 7(*a*). If needed, the hexagon head bolt 24 may also be loosened, and the shaft bearing member 22 may be laterally slid with respect to the frame attachment member 23 as shown in FIG. 7(*c*).

The adjustment in the direction of the depth of the door 5 may be made by rotating the eccentric bolt 15 with a screw driver as shown in FIG. 7(*b*) after the alignment fixing screw is loosened. This procedure is discussed in detail below with reference to FIG. 8.

Figure 8:
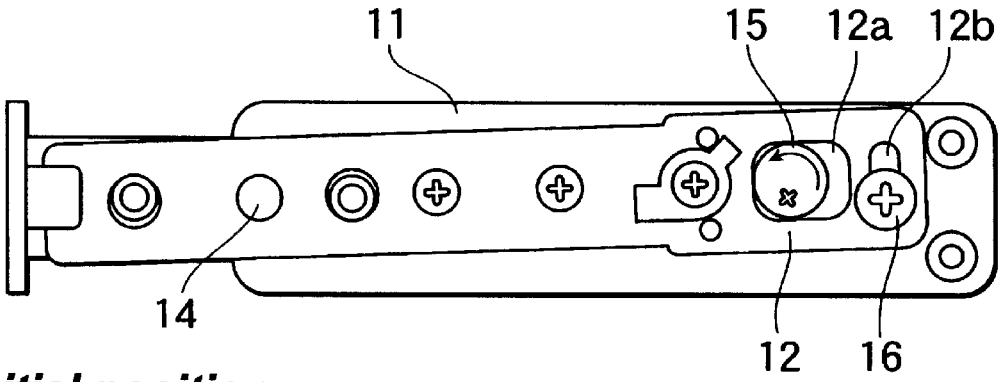
FIG. 8 is a plan view of the upper unit of FIG. 2, explaining the mechanism of adjustment of the door alignment in the direction of depth of the door.
Figure 8:
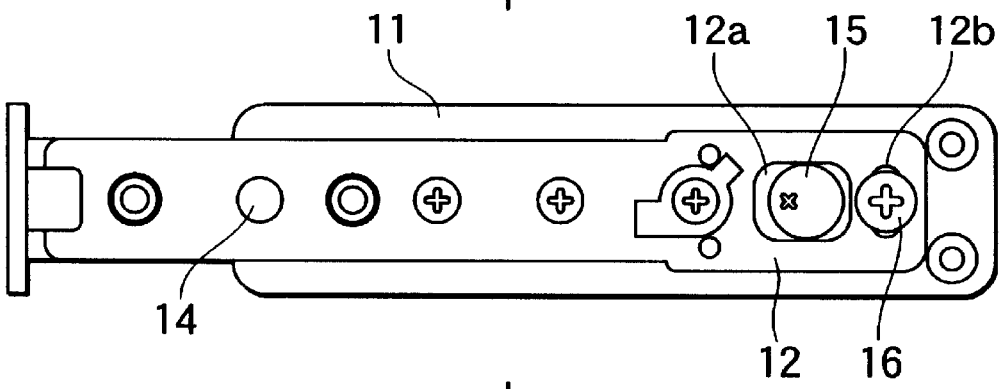
Figure 8:
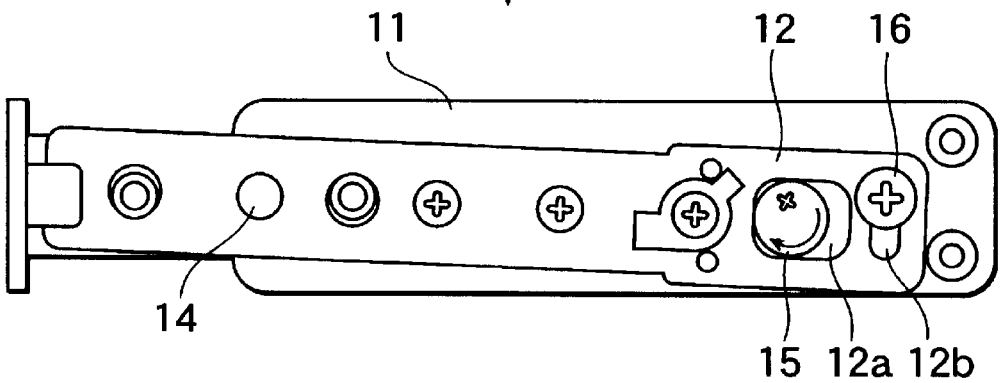

When the eccentric bolt 15 is rotated counterclockwise as shown in FIG. 8(*a*) from its initial position shown in FIG. 8(*b*), the bolt 15 contacts and pushes the periphery of the depth adjuster aperture 12*a*, which causes the frame-side connector member 12 to rotate also counterclockwise around the caulking pin 14. In contrast, when the eccentric bolt 15 is rotated clockwise as shown in FIG. 8(*c*), the bolt 15 pushes the frame-side connector member 12 to rotate also clockwise around the caulking pin 14. That is, the rotation of the eccentric bolt 15 results in change in the distance between the center of rotation of the bolt 15 and the periphery of the depth adjuster aperture 12*a*, which causes the frame-side connector member 12 to displace depending on the magnitude and direction of the change.

The vertical adjustment of the door 5 (in the direction of height of the door) may be made by loosening the screws in the elongate slots 23*c* in the frame attachment member 23, and vertically sliding the frame attachment member 23 with respect to the frame jamb.

In the embodiment discussed above, the door supporting device of the present invention includes all of the upper unit 1, the lower unit 2, and the swing stopper 3. However, the invention is not limited to this embodiment, and may be the combination of the upper unit 1 and the lower unit 2, or of the upper unit 1 and the swing stopper 3, and may even include only the upper unit 1.

According to the present invention, the door supporting device is provided which allows adjustment of door alignment with a simple structure and easy operation, which enables any user to adjust the door alignment easily. The door supporting device of the invention is concealed in a space between the door and the door frame, so that the aesthetic appearance of the door is not impaired. Further, the present door supporting device may be manufactured at low cost without significantly increasing the manufacturing steps compared to the conventional door supporting devices.

By rotating the eccentric bolt, which is finely controllable, alignment in the direction of depth of the door may be adjusted precisely.

By laterally sliding the door-side connector member with respect to the frame-side connector member in the upper unit, and/or by laterally sliding the shaft bearing member with respect to the frame attachment member in the lower unit, alignment in the direction of width of the door may be adjusted easily.

By vertically sliding the frame attachment of the lower unit with respect to the door frame, alignment in the direction of height of the door may be adjusted easily.

All of such alignment may easily be adjusted with the door installed in the door frame, so that free adjustment is realized without assistance by others.

Although the present invention has been described with reference to the preferred embodiment, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A door supporting device for supporting a door in a door frame comprising an upper unit, said upper unit further comprising:

a frame attachment member to be fixed to a header of the door frame;

a frame-side connector member rotatably connected to said frame attachment member, said frame-side connector member having an adjuster aperture;

a door-side connector member connected to a rotation shaft extending from an upper surface of said door and detachably connected to said frame-side connector member; and an eccentric bolt connected to said frame attachment member through said adjuster aperture in the frame-side connector member, said eccentric bolt being exposed from said adjuster aperture with at least a portion of said eccentric bolt being in contact with periphery of the adjuster aperture;

wherein rotation of said eccentric bolt makes said frame-side connector member to rotate to adjust alignment of the door with respect to the door frame in a direction of depth of said door.

2. The door supporting device of claim 1, wherein said frame-side connector member has a linking screw for connecting said frame-side and door-side connector members together, and said door-side connector member has a lateral adjuster hole for receiving said liking screw therein, wherein said linking screw and said lateral adjuster hole cooperate to allow lateral sliding of said door-side connector member with respect to said frame-side connector member with said screw being placed in the adjuster hole.

3. The door supporting device of claim 1, wherein said rotation shaft extending from an upper surface of said door is extending from a door closer embedded in the door.

4. The door supporting device of claim 1, further comprising a lower unit, said lower unit comprising:

a shaft housing to be embedded in a lower portion of said door;

a retractable supporting shaft retractably housed in said shaft housing, said shaft being retained in said shaft housing in its retracted position, and extending through a lower end of said shaft housing in its extended position;

a frame attachment member to be slidably attached to a jamb of said door frame, said frame attachment member having a vertical slot therein; and a shaft bearing member having a bushing hole for receiving said retractable shaft in its extended position and slidably connected to said frame attachment member.

5. The door supporting device of claim 4, wherein said shaft bearing member is connected to said frame attachment member with a bolt, and said shaft bearing member has a slit for receiving said bolt and guiding said sliding of said shaft bearing member with respect to said frame attachment member.

6. The door supporting device of claim 1, further comprising a swing stopper to be positioned in an upper portion of the door and frame, said swing stopper comprising:

a magnet casing containing magnet, wherein said magnet casing is to be embedded in the head of the door frame; and a counter plate made of a material attracted by said magnet, wherein said counter plate is to be positioned in the door at a location facing to said magnet casing.

* * * * *

UNITED STATES PATENT AND TRADEMARK OFFICE

CERTIFICATE OF CORRECTION

PATENT NO. : 6,609,335 B1
DATED : August 26, 2003
INVENTOR(S) : Yutaka Hyakkoku

It is certified that error appears in the above-identified patent and that said Letters Patent is hereby corrected as shown below:

Title page,
Item [75], Inventor, "Ebina (JP)" should be -- Ebina-shi (JP) --.
Item [73], Assignee, "Japan Uniflow Col. Ltd., Tokyo (JP)" to
-- Japan Uniflow Co., Ltd., Tokyo (JP) --.

Signed and Sealed this

Fourteenth Day of October, 2003

JAMES E. ROGAN
*Director of the United States Patent and Trademark Office*